US007049569B2

(12) United States Patent
Kim

(10) Patent No.: US 7,049,569 B2
(45) Date of Patent: May 23, 2006

(54) MICROWAVE OVEN WITH AIR CLEANING FUNCTION

(75) Inventor: Seog Tae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/817,876

(22) Filed: Apr. 6, 2004

(65) Prior Publication Data

US 2005/0011888 A1 Jan. 20, 2005

(30) Foreign Application Priority Data

Jul. 16, 2003 (KR) ..... 10-2003-0048919

(51) Int. Cl.
*H05B 6/68* (2006.01)
*F24C 15/30* (2006.01)

(52) U.S. Cl. ..... 219/757; 219/702; 126/21 A; 126/299 D

(58) Field of Classification Search ..... 219/757, 219/702; 126/21 A, 299 D, 299 R
See application file for complete search history.

(56) References Cited

U.S. PATENT DOCUMENTS

| | | | | |
|---|---|---|---|---|
| 4,143,646 A | | 3/1979 | Sampsel | 126/299 D |
| 4,350,504 A | | 9/1982 | Diachuk | 126/299 F |
| 4,418,261 A | | 11/1983 | Jailor et al. | 219/757 |
| 4,682,580 A | | 7/1987 | Fukumoto | 126/299 D |
| 4,886,046 A | | 12/1989 | Welch | 126/299 D |
| 4,902,316 A | * | 2/1990 | Giles et al. | 126/299 D |
| 6,072,169 A | | 6/2000 | Kang et al. | 219/702 |
| 6,329,646 B1 | | 12/2001 | Fukuda et al. | 126/299 D |
| 6,479,806 B1 | * | 11/2002 | Lee et al. | 219/757 |

FOREIGN PATENT DOCUMENTS

| | | | |
|---|---|---|---|
| CN | 1428544 A | | 7/2003 |
| CN | 1185755 C | | 1/2005 |
| CN | 12000223 C | | 5/2005 |
| GB | 2 186 964 A | | 8/1987 |
| JP | 11-14072 | * | 1/1999 |
| KR | 1998-0085074 | | 12/1998 |

* cited by examiner

*Primary Examiner*—Philip H. Leung
(74) *Attorney, Agent, or Firm*—Birch Stewart Kolasch & Birch LLP

(57) ABSTRACT

Disclosed is a microwave oven with an air cleaning function. The microwave oven includes an air cleaning button formed on a control panel of the microwave oven, a controller for determining an input signal from the air cleaning button and generating a driving signal, and a fan driving part for operating a fan disposed in the microwave oven to allow intake air to pass through a filter, thereby removing pollutants contained in the intake air.

27 Claims, 7 Drawing Sheets

MICROWAVE OVEN WITH AIR CLEANING FUNCTION

This Nonprovisional application claims priority under 35 U.S.C. § 119(a) on Patent Application No(s). 10-2003-0048919 filed in Korea on Jul. 16, 2003, the entire contents of which are hereby incorporated by reference.

BACKGROUND OF THE INVENTION

1. Field of the Invention

The present invention relates to a microwave oven, and more particularly, to a microwave oven with an air cleaning function that can improve not only the kitchen environment but also the overall interior environment by quickly removing polluted air containing, for example, fumes, moisture, and oil that are generated during cooking process to worsen the kitchen environment.

2. Description of the Related Art

A microwave oven is a sort of cooking apparatus having a magnetron for generating and directing a microwave to food loaded in a cooking cavity of the microwave oven to lead to the molecular movement generating heat for the food.

Particularly, in recent years, an over-the-range (OTR) type microwave oven that is placed over a main cooking device such as a gas oven range has been developed. The OTR type microwave has a function of the cooker itself as well as a function of ventilator that removes fumes and/or moisture generated in the main cooking device during the cooking process. Such an OTR type microwave oven is already well known through publications disclosed by the applicant (assignee) of the present invention. However, the present invention is not limited to such an OTR type microwave oven.

However, the conventional OTR type microwave oven provides only a function for forcedly exhausting polluted air generated during the cooking process. That is, since only the function for forcedly exhausting polluted air generated during the cooking process is provided, an air cleaning function is not be not realized while the microwave oven is not being operated.

Meanwhile, even after the cooking process is finished, the kitchen air may be still in a polluted state due to residual odor particles. Therefore, there is a need for maintaining the air cleaning function even after the cooking process is finished. That is, in order to prevent the kitchen environment from being deteriorated due to the residual odor particles in the kitchen, the air cleaning function should be played at any time a user likes, thereby keeping the kitchen clean and fresh.

Particularly, such an air cleaning function is more keenly required for home environment having a kitchen and a living room that are formed in a single space.

SUMMARY OF THE INVENTION

Accordingly, the present invention is directed to a microwave oven with an air cleaning function that substantially obviate one or more problems due to limitations and disadvantages of the related art.

An object of the present invention is to provide a microwave oven with an air cleaning function that can keep interior environment clean and fresh.

Another object of the present invention is to provide a microwave oven with an air cleaning function that is designed to be operated at any time a user likes to thereby prevent the kitchen environment from being deteriorated due to the residual odor particles in the kitchen.

Still another object of the present invention is to provide a microwave oven with an air cleaning function that can keep interior environment clean and fresh by removing any particles causing the generation of odor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the present invention provides a microwave oven with an air cleaning function, the microwave oven comprising an air cleaning button formed on a control panel of the microwave oven; a controller for determining an input signal from the air cleaning button and generating a driving signal; and a fan driving part for operating a fan disposed in the microwave oven to allow intake air to pass through a filter, thereby removing pollutants contained in the intake air.

In another aspect of the present invention, there is provided a microwave oven with an air cleaning function, the microwave oven comprising an intake duct part defined between outer case and inner cases of the microwave oven; a fan associated with the intake duct part; a discharge duct part connected to a discharge side of the fan to discharge the air to an interior; and at least one filter for filtering pollutants out of the air, the filter being disposed in the discharge duct part and selected from the group consisting of a carbon absorption-fabric, a high-voltage applicable filter and a catalytic filter.

In still another aspect of the present invention, there is provided a method for using a microwave oven with an air cleaning function, the method comprising the steps of selecting an air cleaning mode; operating a fan for a predetermined time to filter pollutants contained in air; and stopping the fan.

In still yet another aspect of the present invention, there is provided a microwave oven with an air cleaning function, the microwave oven comprising an air cleaning button formed on the microwave oven; a fan operated by manipulating the air cleaning button; and a filter disposed on a flow path of air sucked by the fan to filter pollutants contained in the air.

According to the present invention, since the microwave oven of the present invention has an air cleaning function, interior air can be kept more clean and fresh. Particularly, the air in the kitchen where the polluted air is mostly generated can be kept more clean and fresh.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
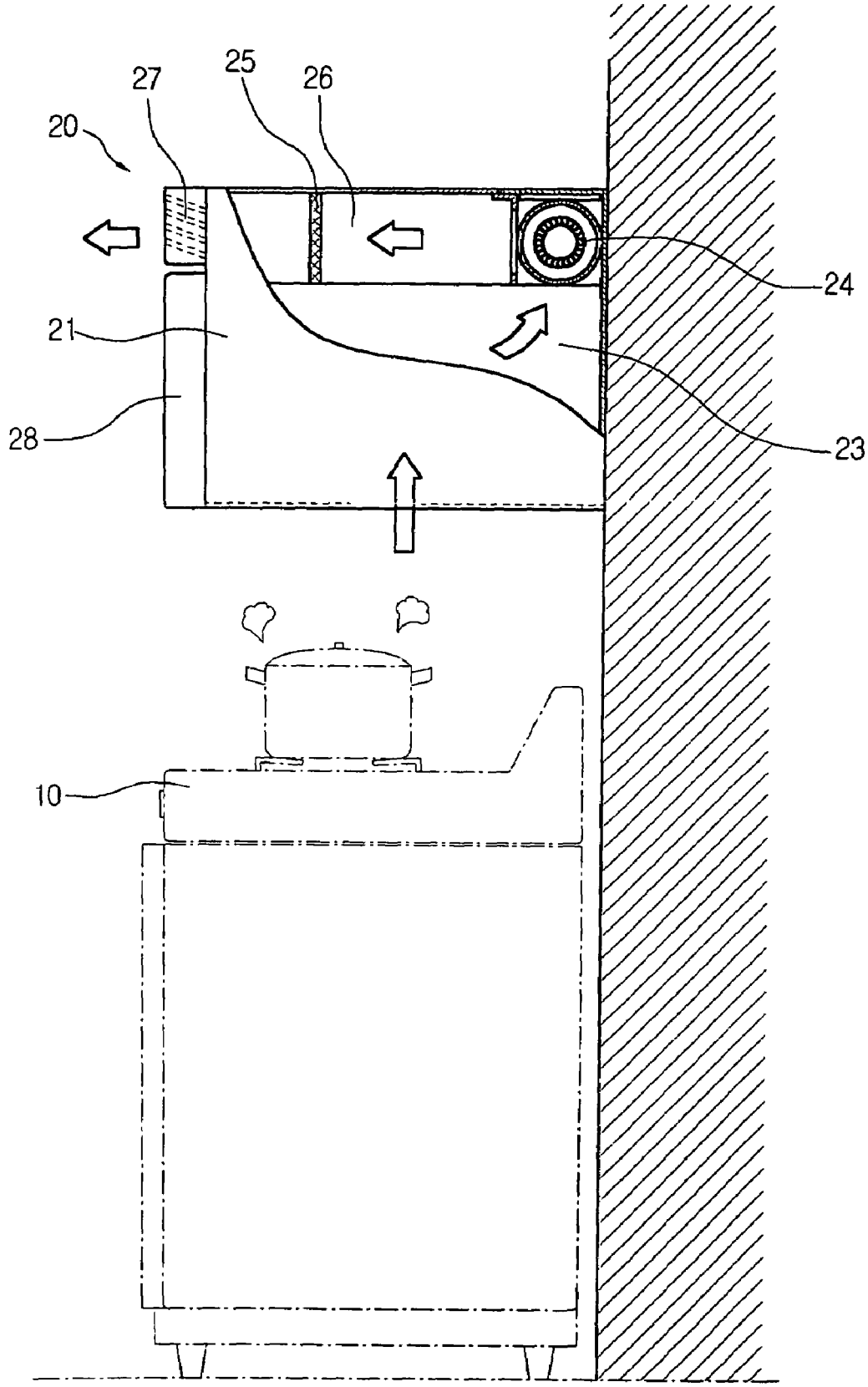
FIG. 1 is a view illustrating a combination of a microwave oven with an air cleaning function according to the present invention and main cooking device.

FIG. 1 shows a view illustrating a combination of an OTR type microwave oven with an air cleaning function according to the present invention and a main cooking device.

As shown in the drawing, there is shown a main cooking device 10 such as a gas oven range and a microwave oven 20 for exhausting polluted air containing fumes and/or moisture generated by the cooking device 10.

The microwave oven 20 comprises a cover 21 defining an outer appearance of the microwave oven 20, an intake duct part 23 for receiving the polluted air from the main cooking device 10, a blower fan 24 for forming a forced-flow of the polluted air received through the intake duct part 23, a discharge duct part 26 for directing the polluted air exhausted through the blower fan 24 to an interior, a filter 25 disposed in the discharge duct part 26, a grill 27 disposed on a discharge end of the discharge duct part 26, and a door 28 formed on a front side of the cover 21. For the convenience of the description, the microwave oven 20 is partly cut-way in the drawing.

The microwave oven 20 is further provided at an inside thereof with a cooking cavity (not shown) where food is placed. A magnetron (not shown) for eradiating electron wave to food may be also further provided on a side portion of the cooking cavity.

The operation of the microwave oven 20 will be described hereinafter.

Polluted air containing fumes and/or moisture is generated in the course of the cooking process in the main cooking device 10. The polluted air is directed to the microwave oven 20 through the intake duct part 23 by the blower fan 24, and is then exhausted through the discharge duct part 26, in the course of which pollutants contained in the polluted air is filtered by the filter 25.

The microwave oven 20 is operated not only during the cooking process in the main cooking device 10 but also when odor particles are contained in interior air, thereby keeping the interior air clean and fresh.

Figure 2:
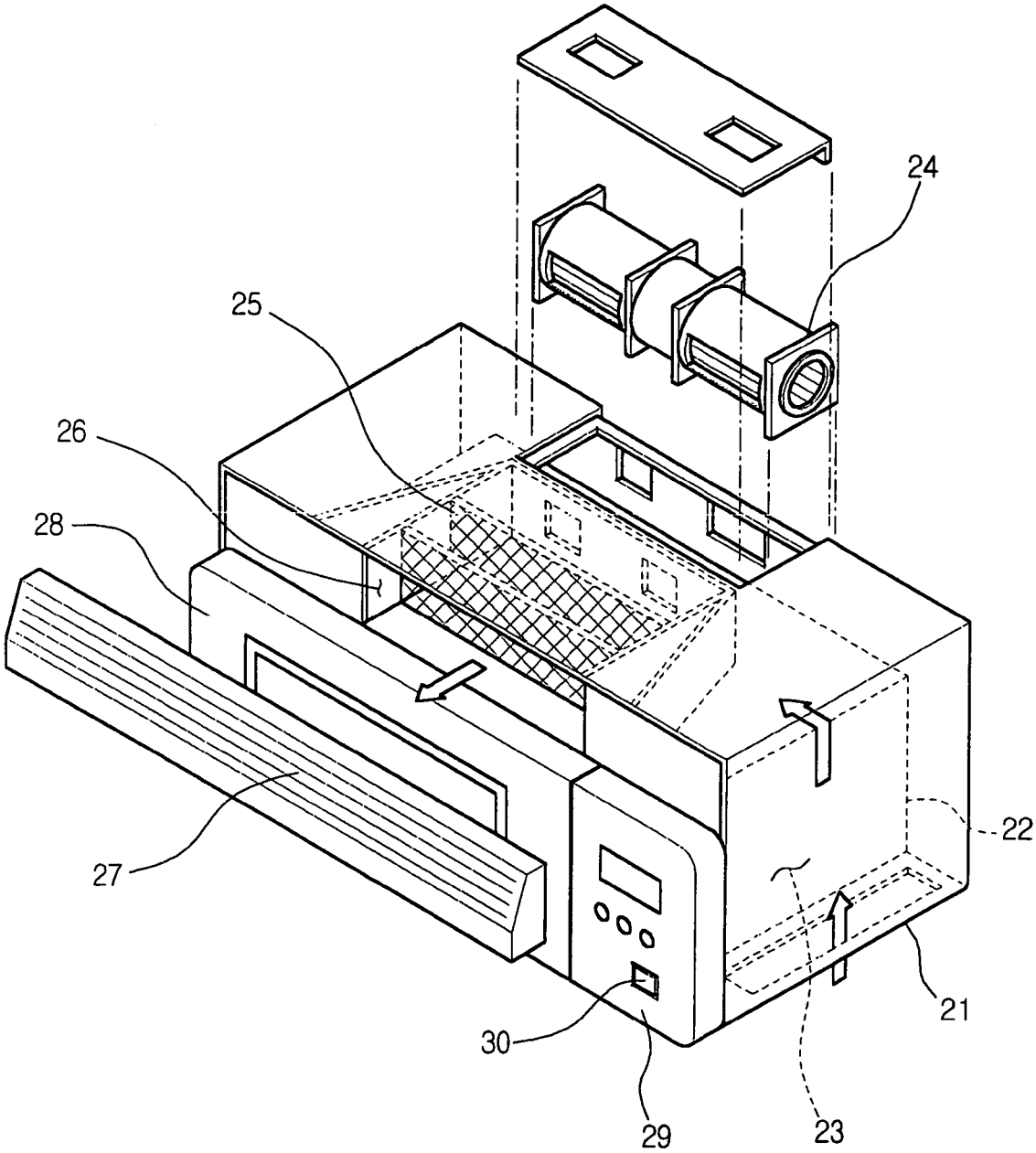
FIG. 2 is an exploded perspective view of a microwave oven with an air cleaning function according to a first embodiment of the present invention.

FIG. 2 is an exploded perspective view of a microwave oven with an air cleaning function.

As shown in the drawing, the inventive microwave oven comprises a cover 21 defining an outer appearance of the microwave oven, an inner case 22 disposed in the cover 21, an intake duct part 23 defined between the inner case 23 and the cover 21, a blower fan 24 for generating suction force directing polluted air into the intake duct part 23, a discharge duct part 26 for discharging the polluted air exhausted through the blower fan 24 to an interior, and a filter 25 disposed in the discharge duct part 26.

The microwave oven further comprises a grill 27 formed on a discharge end of the discharge duct part 26 and a front door 28 formed under the grill to load and unload food in and from the cooking cavity (not shown).

The microwave oven 20 further comprises a control panel 29 formed on the front side of the microwave oven for controlling the operation of the microwave oven. An air cleaning button 30 is formed on the control panel 29.

Figure 3:
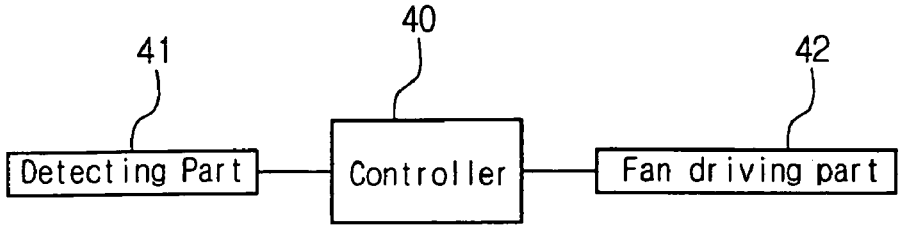
FIG. 3 is a block diagram illustrating an air cleaning function of a microwave oven according to the present invention.

FIG. 3 shows a block diagram illustrating an air cleaning function of a microwave oven according to the present invention.

As shown in the drawing, the microwave oven with the air cleaning function comprises an air cleaning button 41 formed on a front portion of the microwave oven, a controller for controlling the air cleaning function by receiving an air cleaning selection mode signal input from the air cleaning button part 41, and a fan driving part 42 operated in accordance with a control signal from the controller 40.

The air cleaning button part 41 may comprise a series of operation lines as well as the air cleaning button 30 depicted in FIG. 2. In addition, the controller 42 may comprise a microprocessor including a storage device and an operation device.

The air cleaning function of the microwave oven according to the present invention will be described hereinafter.

When a user pushes the air cleaning button 41, a corresponding control signal is transmitted to the controller 40. The transmitted control signal is determined by the controller 40 and is then transmitted to the fan driving part 42 to operate the blower fan 24 disposed in the microwave oven. The polluted air in the interior is sucked by the blower fan 24 and is filtered by the filter, after which the operation of the blower fan is stopped, thereby finishing the air cleaning function of the microwave oven.

In addition, the microwave oven with the air cleaning function is also designed to quickly exhaust fumes and/or moisture contained in the polluted air generated during the cooking process. However, as a feature of the present invention, the above-described air cleaning function for purifying interior air even when either the main cooking device or the microwave oven is not operated is additionally added to the microwave oven.

That is, by designing the blower fan to be operated with low noise and low speed for a long time, the interior air can be continuously purified. That is, an RPM of the blower fan for the air cleaning function is set to be lower than that for ventilation during the cooking process.

Describing more in detail, a high density of pollutants contained in the polluted air generated during the cooking process is quickly removed by powerful suction force generated by the blower fan rotated with a high RPM.

A low density of pollutants contained in the polluted air spread in the interior is slowly removed by weak suction force generated by the blower fan rotated with a low RPM. When the polluted air is sucked by the weak suction force, although the removing speed of the pollutants is low, the noise can be reduced.

The low RPM of the blower fan can be realized by applying a low voltage to a motor by changing a circuit structure or lowering the electric field by reducing the number of wire turns of the motor.

An operation of the microwave oven with the air cleaning function will be described more in detail hereinafter in conjunction with the accompanying drawing.

Figure 4:
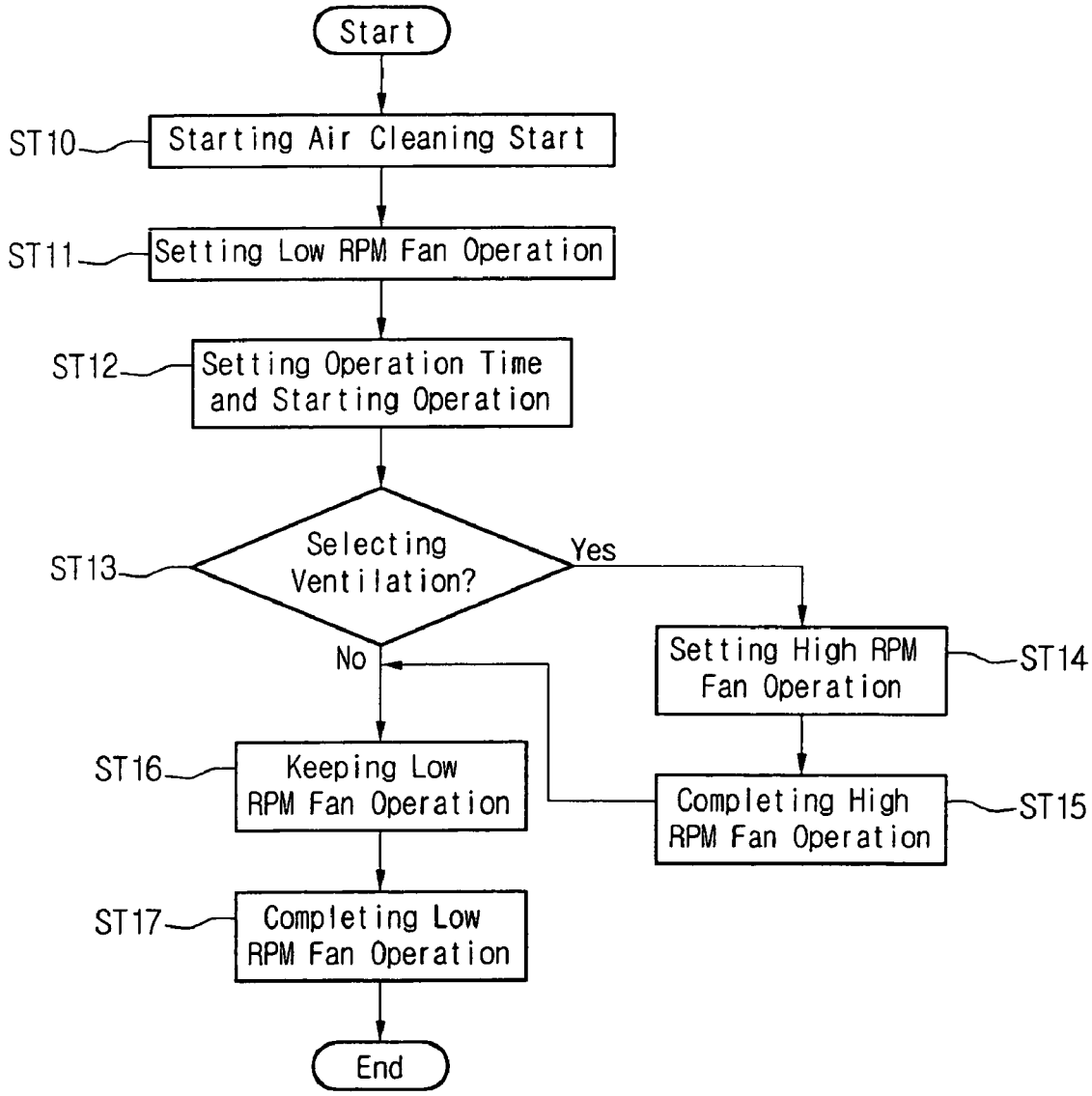
FIG. 4 is a flowchart illustrating an operational method of a microwave oven with an air cleaning function according to the present invention.

FIG. 4 shows a flowchart illustrating an operation of the microwave oven with the air cleaning function.

As shown in the flowchart, when a user pushes the air cleaning button 30 depicted in FIG. 2 (ST10), a mode for operating the fan with a low RPM and low noise is set (ST11). Next, a fan operation time is set (ST12). That is, when the pollution of the interior air is severe, the fan is set to be operated for a long time, and when the pollution of the interior air is not severe, the fan is set to be operated for a short time.

A method for setting an operation time of the fan with a low RPM will be described more in detail hereinafter.

When the user shortly pushes the air cleaning button once, the fan is continuously rotated with the low RPM until there is a user's next command. When the user shortly pushes the air cleaning button twice, the fan is stopped after it rotates with the low RPM for an hour. When the user shortly pushes the air cleaning button three times, the fan is stopped after it rotates with the low RPM for two hours.

However, the operation time setting for the fan is not limited to the above-described method. For example, a special time setting button may be further provided so that the time setting can be separately realized. In addition, it may be also possible to select one of a continuous operation mode or a timer mode by differentiating a pushing stroke time of the air cleaning button.

When the fan operation mode setting (ST11) and the operation time setting (ST12) are completed, the fan is immediately operated with the low speed.

While the fan is being operated with the low RPM, there may be necessary to quickly exhaust polluted air to an exterior (i.e., when food is cooked in the main cooking device). In case for this, detecting means for detecting a status of polluted air is provided. It is determined by the detecting means that a ventilation mode should be selected (STl3). When it is determined that there is no need of selecting the ventilation mode, the fan keeps operating with the low RPM (STl6). When the time set in the operation time setting step ST12 is elapsed, the operation of the fan with the low RPM is stopped (ST17).

However, when the detecting means detects that food is being cooked, and thereby there is a need of selecting the ventilation mode, a high RPM operation mode for the fan is set to quickly exhaust polluted air to the exterior (STl4).

Afterwards, when the exhaustion of polluted air is completed after a predetermined time is elapsed (STl5), the fan is operated with the low RPM (STl6). After the time for operating the fan with the low RPM is elapsed, the operation of the fan with the low RPM is stopped (STl7).

However, the time spent in operating the fan with the high RPM in the step ST14 may not be included in the time set in the operation time setting step ST12. That is, it is preferable that the operation time set by the user for operating the fan with the low RPM can be fully utilized.

Figure 5:
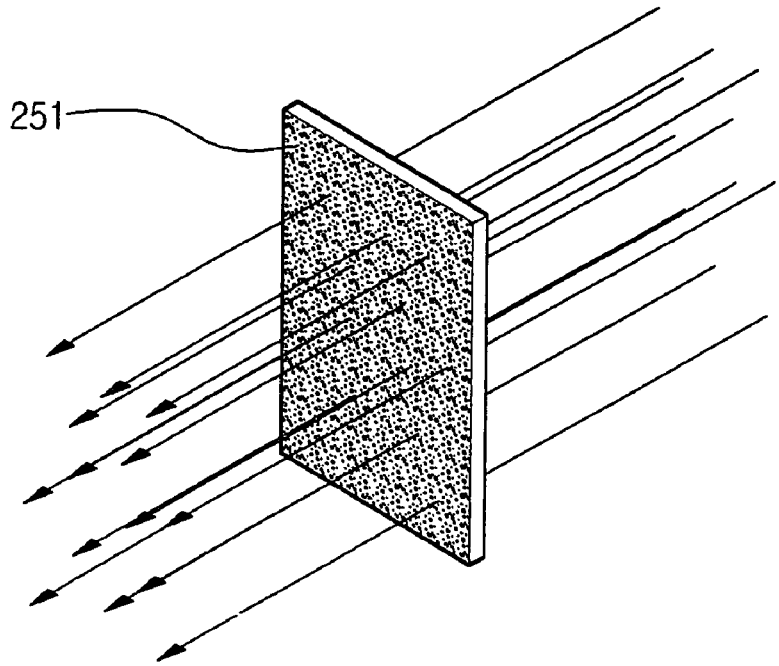
FIGS. 5, 6 and 7 are views illustrating a variety of examples of a filter employed to a microwave oven with an air cleaning function according to the present invention.
Figure 6:
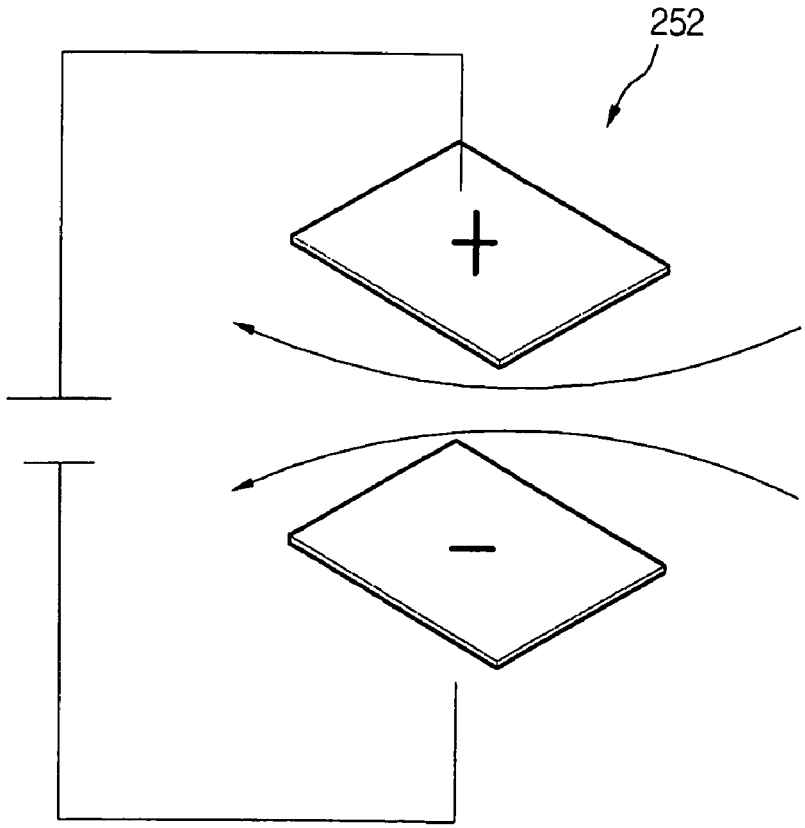
Figure 7:
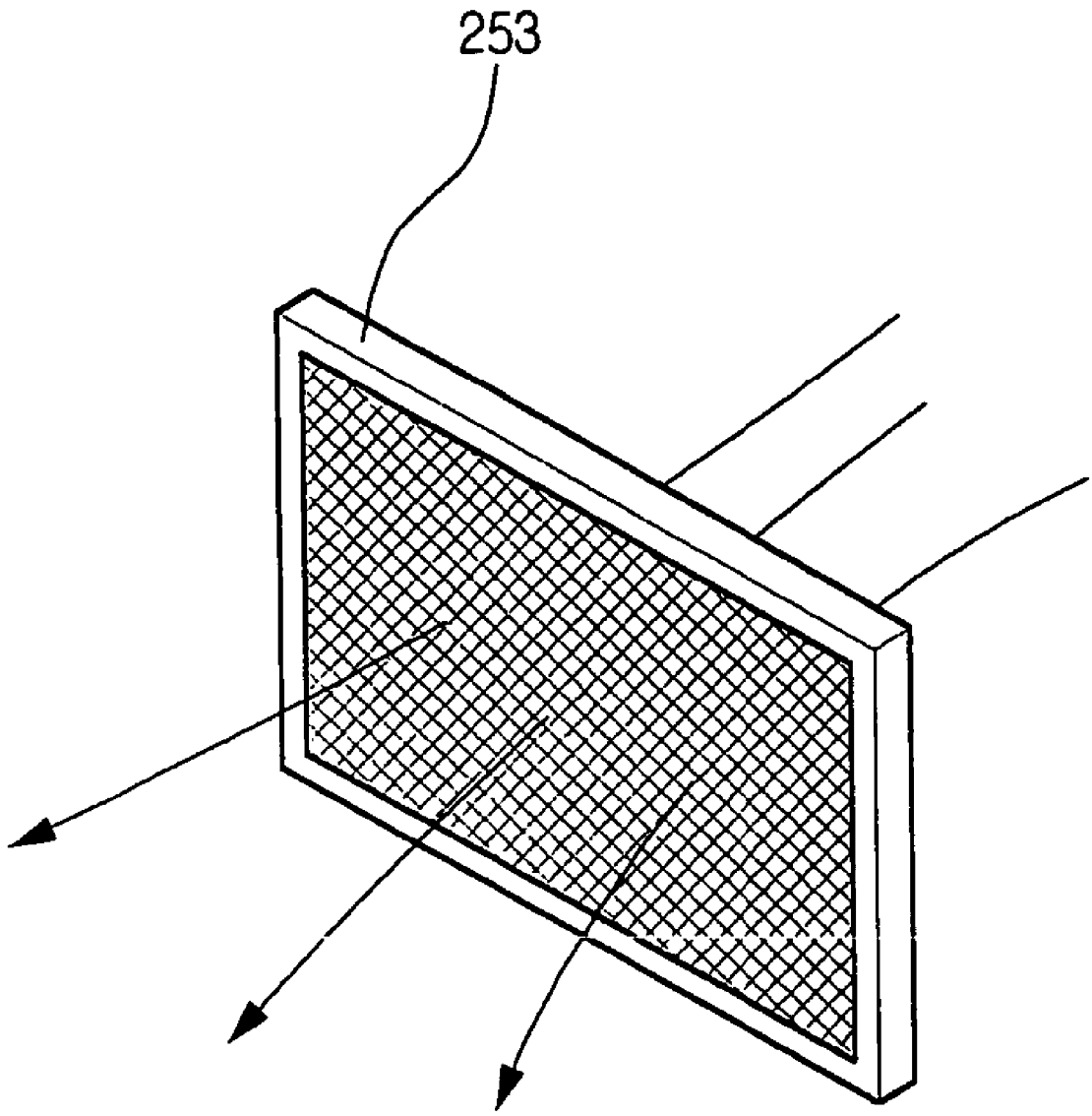

FIGS. 5, 6 and 7 show a variety of examples of a filter employed to a microwave oven with an air cleaning function according to the present invention.

Referring first to FIG. 5, the filter 25 depicted in FIG. 2 is formed of a carbon absorption-fabric 251 having a porous portion for absorbing odor particles, the porous portion being formed while organic matter is oxidized.

Referring to FIG. 6, there is shown a high-voltage applicable filter 252. The high voltage applicable filter 252 comprises an anode and a cathode between which an electric field is formed when high voltage is applied to the anode and the cathode. Therefore, pollutants passing a space defined between the anode and the cathode are charged with electricity, thereby being absorbed on the anode and the cathode.

It is preferable that the anode and the cathode are formed in a plate-shape so that the pollutants can be easily absorbed.

Referring to FIG. 7, there is shown a catalytic filter 253 coated with $TiO_2$. That is, the catalytic filter comprises a fabric mesh coated with a catalyst on which the polluted particles are absorbed.

The filter of the present invention can be formed of one or a combination selected from the group consisting of the above-described variety of filters, i.e., the absorption fabric, the high-voltage applicable filter, and the catalytic filter. It is more preferable that plural filters are simultaneously employed in order to effectively realize the air cleaning function of the present invention.

Figure 8:
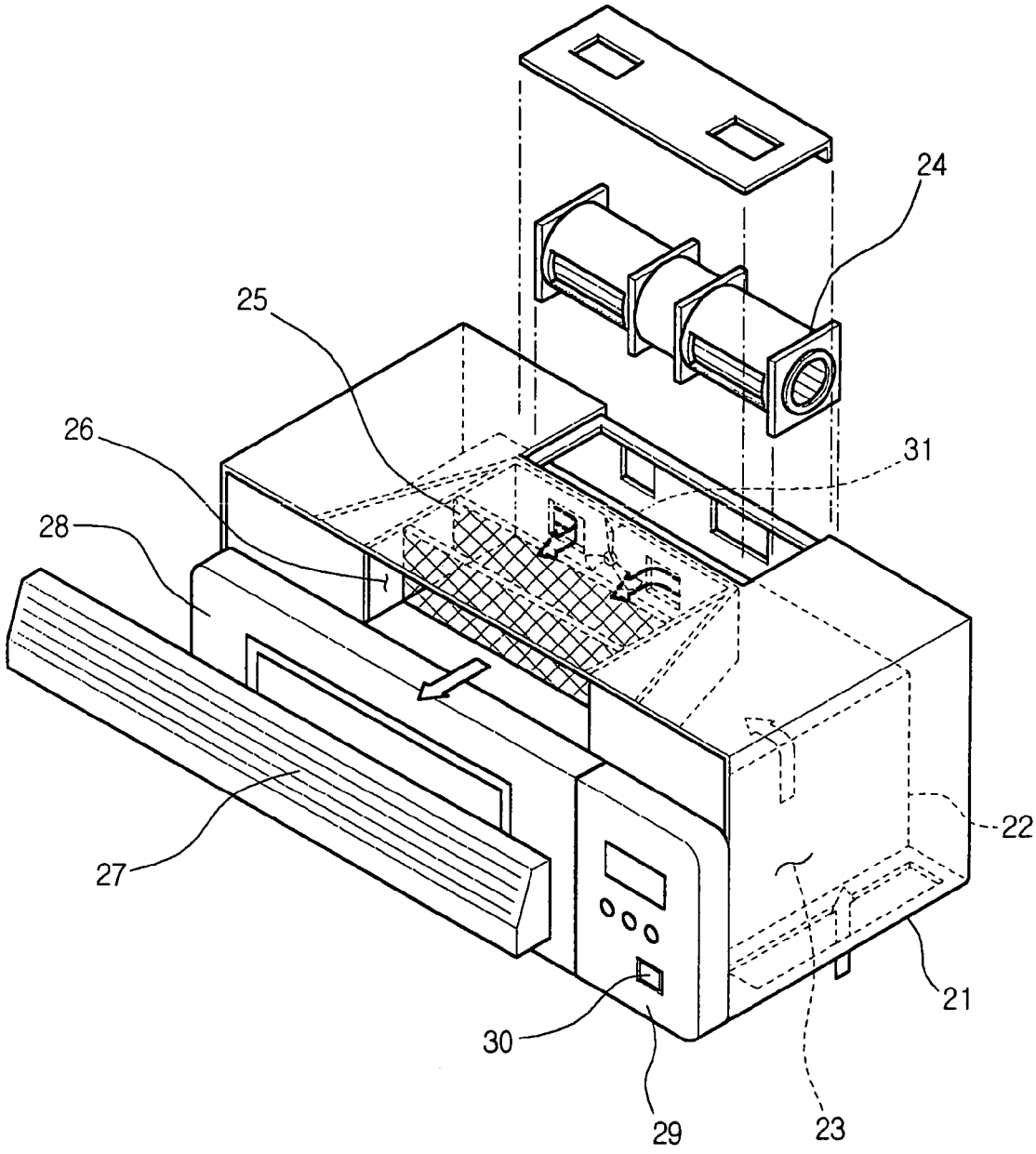
FIG. 8 is a view of a microwave oven with an air cleaning function according to a second embodiment of the present invention.

FIG. 8 shows a microwave oven with an air cleaning function according to a second embodiment of the present invention.

As shown in the drawing, the microwave oven of this embodiment is identical to that of the first embodiment depicted in FIG. 2 except that an additional blower fan 31 is further provided only for the air cleaning function. That is, the blower fan 24 is not used for the air cleaning function but for the ventilation.

The blower fan 31 is mounted on in the discharge duct part 26 so that the removal of pollutants by the filter 25 can be more quickly realized.

Accordingly, when the air cleaning function is selected through the air cleaning button 41 depicted in FIG. 3, the controller 40 depicted in FIG. 3 does not operate the blower fan 24 but the blower fan 31 to discharge the polluted air to the interior after the pollutants contained in the polluted air are filtered by the filter 25.

As described above, by operating the blower fan 31 just for the air cleaning function rather than the blower fan 24 for the ventilation, the electric power loss and the noise generation can be further reduced.

Figure 9:
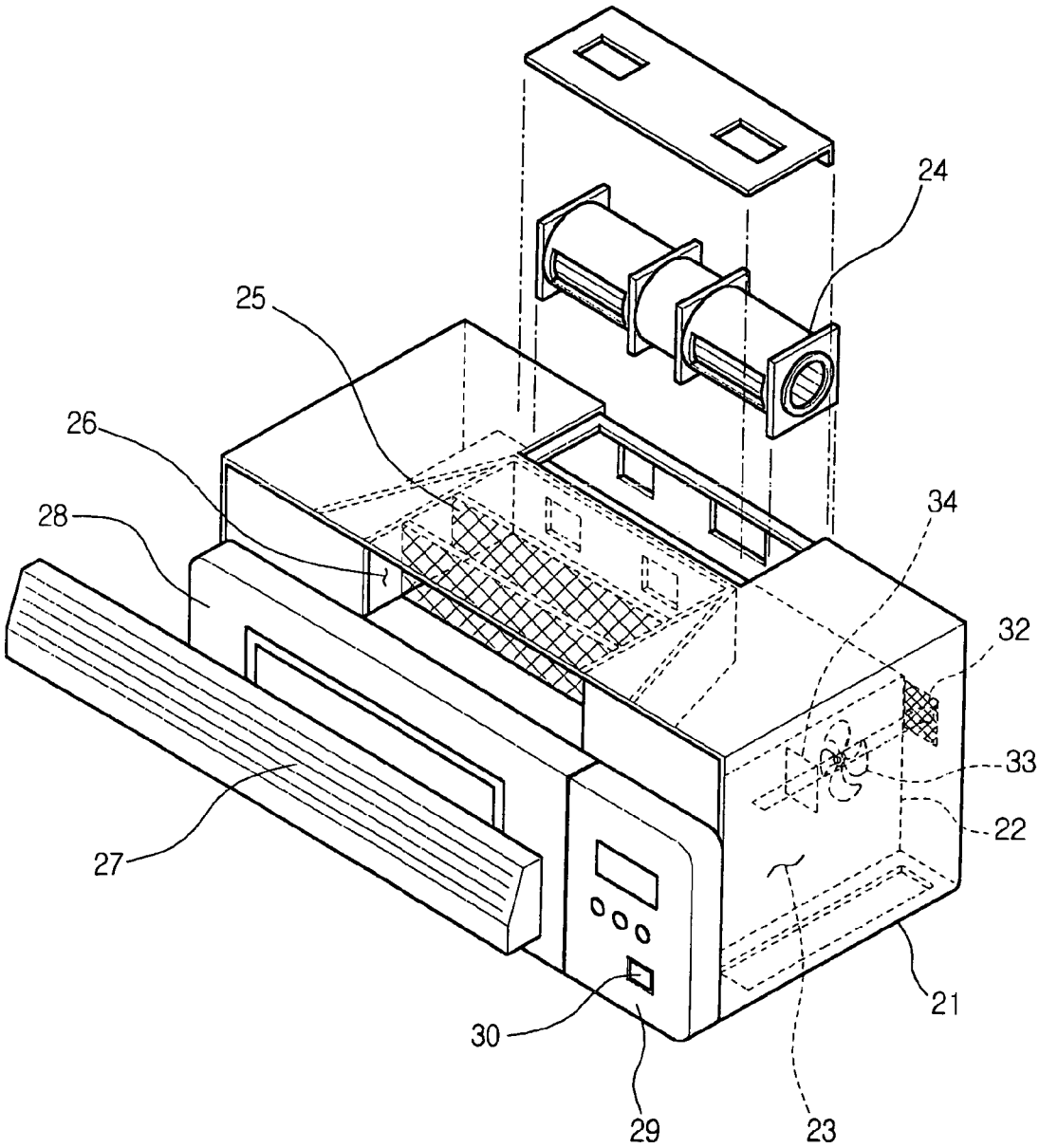
FIG. 9 is a view of a microwave oven with an air cleaning function according to a third embodiment of the present invention.

FIG. 9 shows a microwave oven with an air cleaning function according to a third embodiment of the present invention.

As shown in the drawing, the microwave oven of this embodiment is identical to that of the first embodiment depicted in FIG. 2 except that the air cleaning function is realized by the blower fan but by a cooling fan 33 for cooling a circuit board in an electric component section.

To realize the air cleaning function, the cooling fan 33, a greed 32 disposed on a discharge end of the cooling fan to discharge air sucked by the cooling fan 33 to the exterior, and a filter disposed on an upstream end of the cooling fan 33 to filter the pollutants contained in the air are provided in the electric component section. In this case, the filter 25 formed on the discharge end of the blower fan 24 can be omitted or, when a plurality of filter 25 is provided, the number of filters 25 may be reduced.

As described above, by disposing the filter 34 on an upstream end of the cooling fan 33, the pollutants contained in the air can be filtered without deteriorating the intake/exhaust efficiency of the cooling fan 33 while maintaining the inherent cooling function of the cooling fan.

As a modified example of the third embodiment, the greed 32 and the filter 34 may be designed to be overlapped on each other. In this case, the intake/exhaust efficiency of the cooling fan 33 may be deteriorated, but the filtering efficiency may be improved.

Although the concept of the present invention is described based on the OTR type microwave oven, it is also possible to apply the concept of the present invention to a normal stand-alone type microwave oven with a fan.

As described above, since the microwave oven of the present invention has an air cleaning function, interior air can be kept more clean and fresh. Particularly, the air in the kitchen where the polluted air is mostly generated can be kept more clean and fresh.

In addition, since the microwave oven is designed to operate the air cleaning function at any time the user likes, residual odor particles in the interior can be removed even when food is not cooked, thereby keeping the interior clean and fresh.

Furthermore, since the fan is operated with a low RPM and low noise in the air cleaning function mode, the user keeps the interior air clean and fresh without being disturbed from the noise.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A microwave oven with an air cleaning function, the microwave oven comprising:

an air cleaning button formed on a control panel of the microwave oven;

a controller for determining an input signal from the air cleaning button and generating a driving signal; and a fan driving part for operating a fan disposed in the microwave oven to allow intake air to pass through a filter, thereby removing pollutants contained in the intake air, wherein the microwave oven is an over-the-range microwave oven under which a separate cooking device is disposed, and wherein the controller generates a low speed driving signal to operate the fan at a predetermined speed during an air cleaning mode, the predetermined speed being lower than a speed of ventilation for ventilating the pollutants when the separate cooking device operates during a cooking process, the air cleaning mode being a mode for cleaning the surrounding air of the microwave when the separate cooking device stops operating.

2. The microwave oven according to claim 1, wherein the fan is a blower fan for sucking air into the microwave oven.

3. The microwave oven according to claim 1, wherein the fan is a cooling fan for cooling down an electric component section formed in the microwave oven.

4. The microwave oven according to claim 1, wherein the fan is a blower fan specially disposed in an air flowing path in the microwave oven.

5. The microwave oven according to claim 1, wherein the fan is a crossflow fan.

6. The microwave oven according to claim 1, wherein the fan rotates along a horizontal axis, the horizontal axis being perpendicular to a flow path of the air from the discharge side of the fan to the discharge opening.

7. A microwave oven with an air cleaning function, the microwave oven comprising:

an air cleaning button formed on the microwave oven;

an intake duct part to inhale surrounding air;

a fan associated with the intake duct part, the fan rotating at a predetermined speed when a separate cooking device which is disposed under the microwave oven stops operating to reduce a noise during an operation by the control of the air cleaning button, the predetermined speed being lower than a speed of ventilation for ventilating the pollutants when the separate cooking device operates during a cooking process;

a discharge duct part connected to a discharge side of the fan to discharge the air to an interior; and at least one filter for filtering pollutants out of the air, the filter being disposed in the discharge duct part and selected from the group consisting of a carbon absorption-fabric, a high-voltage applicable filter and a catalytic filter.

8. The microwave oven according to claim 7, wherein the catalytic filter comprises a fabric mesh coated with a catalyst.

9. The microwave oven according to claim 7, further comprising an air cleaning button for operating the fan to realize the air cleaning function, the air cleaning button being formed on the outer case.

10. The microwave oven according to claim 7, wherein the air cleaning button is formed on the outer case.

11. The microwave oven according to claim 7, wherein the high-voltage applicable filter comprises anode and cathode plates to which voltage is applied.

12. The microwave oven according to claim 7, wherein the fan has an inhaling side and a discharge side, the intake duct part defining a channel between an intake opening and the inhaling side of the fan, the discharge duct part defining a channel between the discharge side of the fan and a discharge opening to discharge the air to an interior, the filter being disposed in the discharge duct part between the discharge opening and the discharge side of the fan.

13. The microwave oven according to claim 12, wherein the fan is a crossflow fan.

14. The microwave oven according to claim 13, wherein the fan rotates along a horizontal axis, the horizontal axis being perpendicular to a flow path of the air in the discharge duct part from the discharge side of the fan to the discharge opening.

15. A method for using a microwave oven with an air cleaning function, the method comprising the steps of:

selecting an air cleaning mode;

operating a fan at a predetermined speed for a predetermined time to filter pollutants contained in air when a separate cooking device disposed under the microwave oven stops operating, thereby reducing noise, the predetermined speed being lower than a speed of ventilation for ventilating the pollutants when the separate cooking device operates during a cooking process; and stopping the fan, wherein the predetermined time is adjustable based on a density of the pollutants.

16. The method according to claim 15, wherein the fan is operated with a low RPM mode.

17. The method according to claim 15, further comprising the step of, after selecting the air cleaning mode, setting an operation time of the air cleaning function.

18. The method according to claim 17, wherein the air cleaning mode section and the operation time setting are realized by an identical single button.

19. The method according to claim 15, wherein the air cleaning mode section is realized by a button formed on a control part of the microwave oven.

20. The method according to claim 15, wherein when it is required to operate the fan with a high RPM mode while the fan is being operated with a low RPM mode, the fan is operated with the high RPM mode, after which the fan is again operated with the low RPM mode.

21. The method according to claim 15, wherein, while the fan is being operated with a low RPM mode, when it is required to operate the fan with a high RPM mode due to a high density of pollutants generated by an operation of a cooking device, a time for the high RPM mode is not included in a time set for operating the fan with the low RPM.

22. The method according to claim 15, wherein a fan RPM for the air cleaning function is lower than that for a ventilation, thereby reducing noise.

23. A microwave oven with an air cleaning function, the microwave oven comprising:

an air cleaning button formed on the microwave oven;

a fan operated by manipulating the air cleaning button; and a filter disposed on a flow path of air sucked by the fan to filter pollutants contained in the air wherein the microwave is an over-the-range microwave oven under which a separate cooking device is disposed, and wherein an RPM of the fan when the separate cooking device stops operating is lower than that of ventilation for ventilating the pollutants when the separate cooking device operates during a cooking process.

24. The microwave oven according to claim 23, wherein the air cleaning button is manipulated by a user.

25. The microwave oven according to claim 23, the filter being disposed between the fan and a discharge opening, the filter facing a discharge side of the fan.

26. The microwave oven according to claim 25, wherein the fan is a crossflow fan.

27. The microwave oven according to claim 25, wherein the fan rotates along a horizontal axis, the horizontal axis being perpendicular to the flow path of the air from the discharge side of the fan to the discharge opening.

* * * * *